United States Patent [19]

Meyer

[11] Patent Number: 4,845,793

[45] Date of Patent: Jul. 11, 1989

[54] DUAL VACUUM CLEANER

[75] Inventor: Lawrence L. Meyer, Canton, Ohio

[73] Assignee: Philips Home Products, Inc., Akron, Ohio

[21] Appl. No.: 136,342

[22] Filed: Dec. 22, 1987

[51] Int. Cl.[4] ..... A47L 9/00

[52] U.S. Cl. ..... 15/328; 15/323; 15/327 D; 15/327 F; 15/412; 206/514

[58] Field of Search ..... 15/327 R, 327 F, 327 C, 15/327 D, 344, 323, 328, 412, 347, 352, 353; 206/499, 514

[56] References Cited

U.S. PATENT DOCUMENTS

| | | | |
|---|---|---|---|
| 2,152,756 | 4/1939 | Billmyre | 15/327 F |
| 3,618,297 | 11/1971 | Hamrick | 15/327 F |
| 4,458,377 | 7/1984 | Frohbeiter | 15/328 |
| 4,654,926 | 4/1987 | McCambridge | 15/328 |

FOREIGN PATENT DOCUMENTS

| | | | |
|---|---|---|---|
| 147577 | 7/1952 | Australia | 15/327 R |

*Primary Examiner*—Harvey C. Hornsby
*Assistant Examiner*—Corinne M. Reinckens
*Attorney, Agent, or Firm*—Pearne, Gordon, McCoy & Granger

[57] ABSTRACT

A dual vacuum cleaner is disclosed which includes generally a power unit, a small tank, and a large tank. The power unit includes a motor and an impeller, and is complementary to an access opening of the small tank and also complementary to an access opening of the large tank. The power unit may be fastened to either the small tank or the large tank for selective operation as a small portable vacuum cleaner or as a large wheeled tank-type vacuum cleaner.

11 Claims, 4 Drawing Sheets

DUAL VACUUM CLEANER

BACKGROUND OF THE INVENTION

The present invention relates to vacuum cleaners of the upright tank-type particularly adapted for use in a basement, garage, porch, patio, or the like, and has a smaller vacuum cleaner which may easily be carried, for example, by a shoulder strap and used inside the home, automobile, or for on-floor and off-the-floor cleaning.

In one prior construction, such as disclosed in U.S. Pat. No. 3,775,951, the power unit is a motor and impeller mounted on a cover, and the cover may be fastened to the tank to receive the collected dirt. In tank-type vacuum cleaners of this type, it has been known that the same power unit and attached cover may be fastened to either a six or an eight-gallon tank. The power unit may then be sold with either tank as a smaller or larger tank vacuum cleaner.

SUMMARY OF THE INVENTION

In many cases, a householder would like to use a vacuum cleaner as a heavy-duty cleaner in a basement or a garage, for example, and accordingly would like one which has a wet/dry capability and a fair amount of capacity, so that a wheeled tank for ease of movement of the vacuum cleaner is desired. For other applications, the householder would want a small tank-type vacuum cleaner that could be carried in the hand or slung over a shoulder with a shoulder strap for off-the-floor cleaning or within an automobile, for example, where the large-wheeled tank would be a nuisance.

The problem to be solved, therefore, is how to construct a vacuum cleaner which meets both of these normal needs of a householder.

This problem is solved by a dual vacuum cleaner comprising, in combination, a power unit, a small tank, and a large tank, said power unit including a housing with an attached cover, an electric motor within said housing and an impeller driven by said motor to establish a suction, said small tank having an access opening, said access opening of said small tank being complementary to said cover of said power unit to receive said power unit, said large tank having an access opening, said access opening of said large tank being complementary to said power unit cover to receive said power unit, means fastening said cover selectively to either said small or large tank access openings for permitting operation of the power unit and selected tank as a vacuum cleaner, and one of said power unit and said small tank having a major portion thereof with dimensions sufficiently small to be receivable in said large tank.

The problem is further solved by a dual vacuum cleaner comprising, in combination, a power unit, a small tank, and a large tank, an impeller in said power unit to establish a suction, said small tank having an access opening, said access opening of said small tank being complementary to said power unit, said large tank having an access opening, said access opening of said large tank being complementary to said power unit, means fastening said power unit selectively to either said small or large tank access openings for permitting operation of the power unit and selected tank as a vacuum cleaner, and one of said power unit and said small tank having dimensions small enough to have a major portion thereof receivable in said large tank.

The problem is further solved by a vacuum cleaner having an impeller driven by a power unit, a large tank with an access opening complementary to the power unit, and means to fasten the power unit to the large tank access opening for permitting operation of the power unit and large tank as a vacuum cleaner, characterized in that a small tank has an access opening complementary to said power unit and alternatively attachable to said power unit by said fastening means for operation as a smaller vacuum cleaner, and a major portion of one of said small tank and said power unit having dimensions sufficiently small to permit insertion into said large tank through said access opening thereof for shipping or storage purposes.

Other objects and a fuller understanding of the invention may be had by referring to the following description and claims, taken in conjunction with the accompanying drawings.

DESCRIPTION OF THE PREFERRED EMBODIMENT

Figure 1:
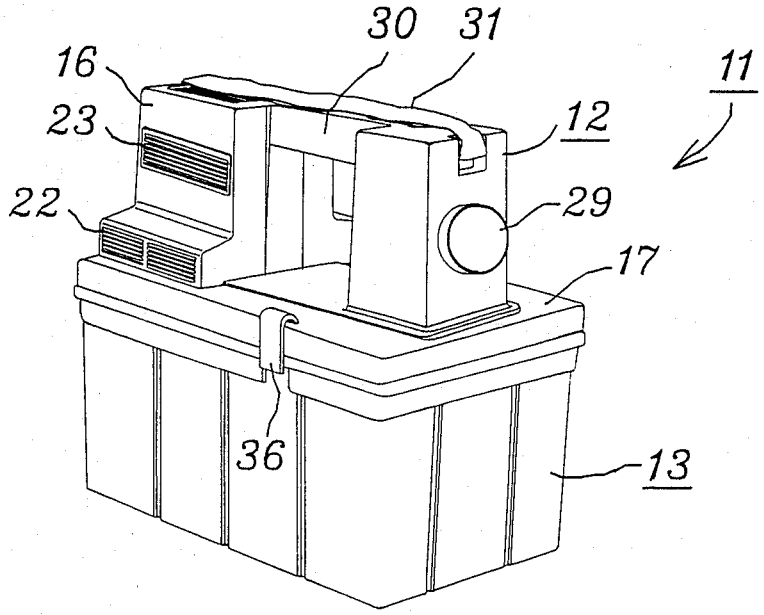
FIG. 1 is a perspective view of the dual vacuum cleaner configured as a small tank vacuum cleaner.
Figure 2:
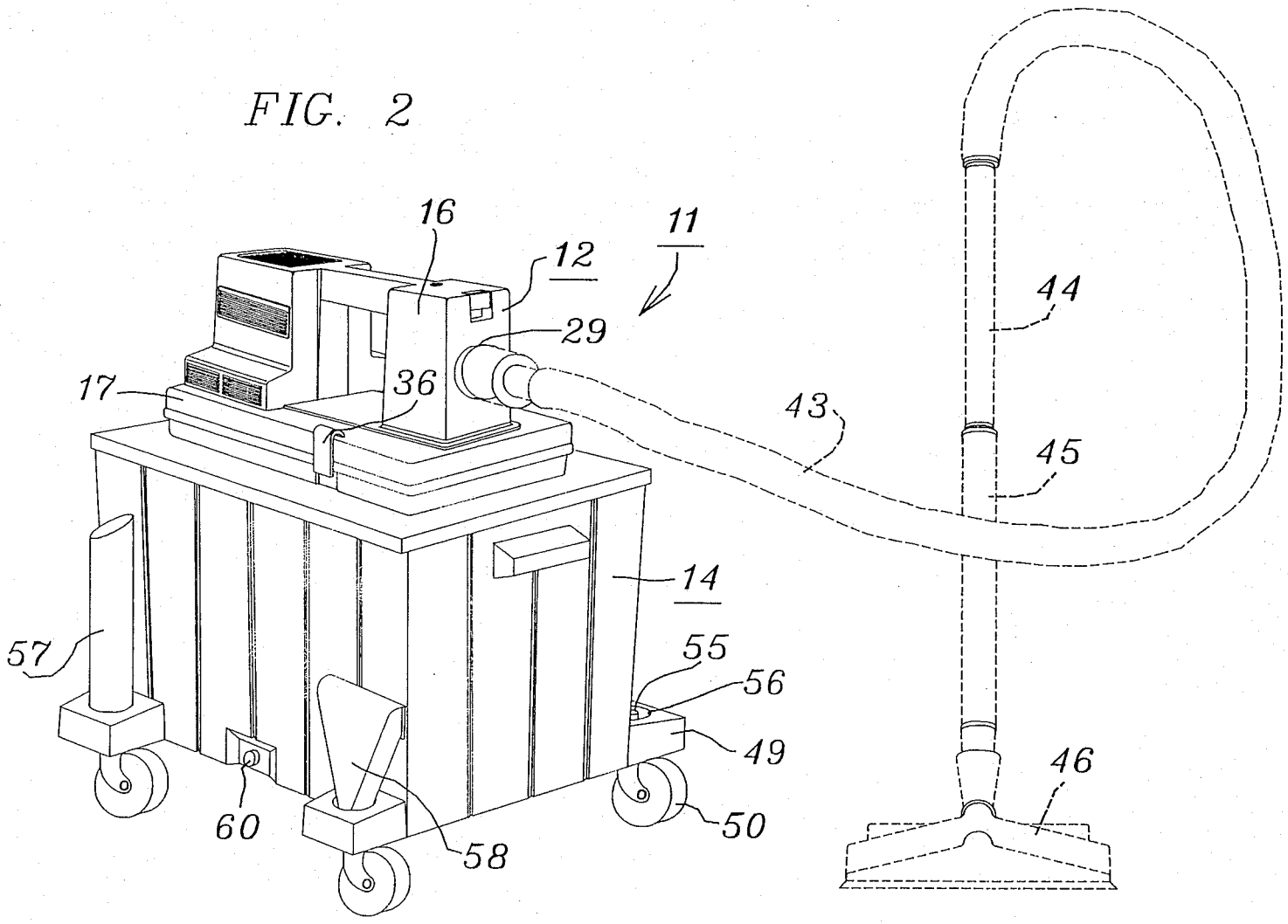
FIG. 2 is a perspective view of the dual vacuum cleaner configured as a large tank vacuum cleaner.
Figure 3:
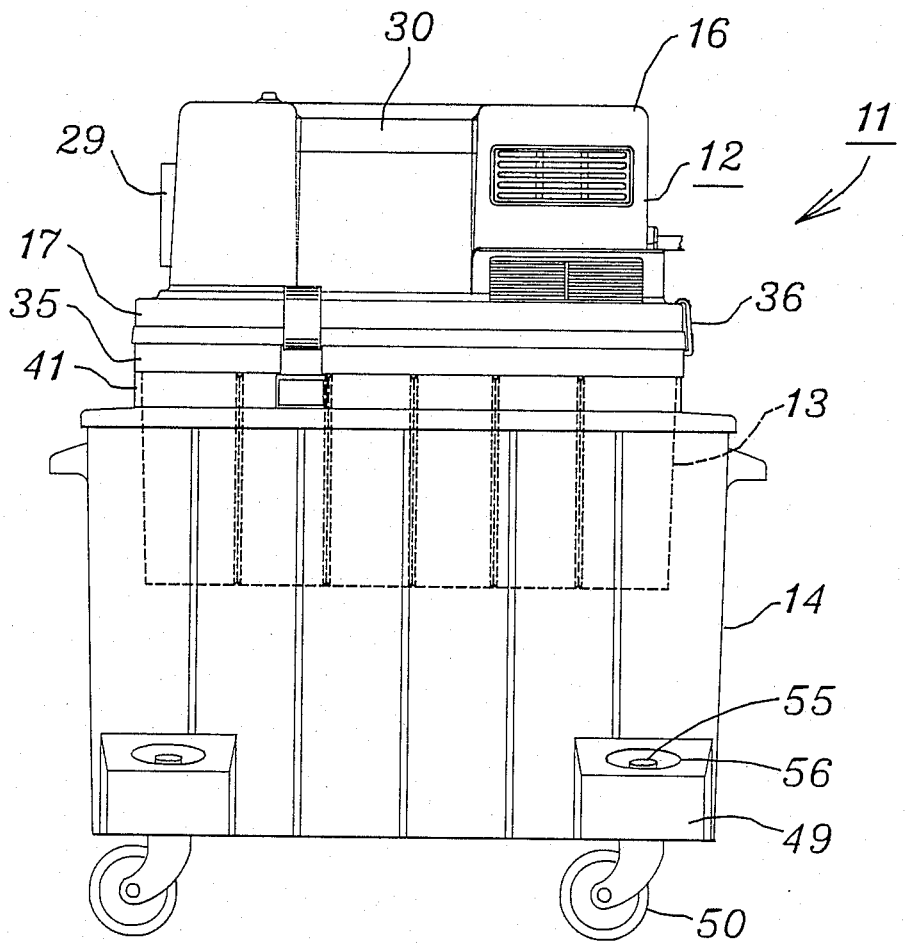
FIG. 3 is a left side elevational view of the large tank vacuum cleaner.
Figure 5:
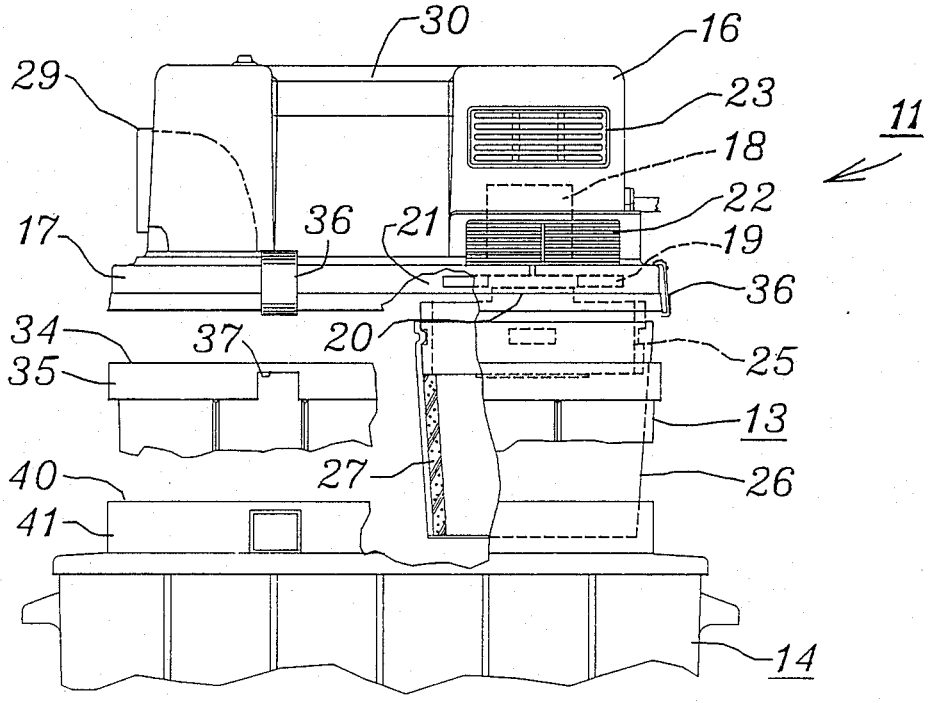
FIG. 5 is an exploded side view of how the dual vacuum cleaner may be nested for storage by the householder.

FIGS. 1 and 2 show a dual vacuum cleaner 11 which includes generally a power unit 12, a small tank 13, and a large tank 14. The tanks 13 and 14 have rigid, non-collapsible walls, for example, made from plastics. The power unit 12 may be alternatively secured to either the small tank 13 or large tank 14, as shown in FIGS. 1 and 2, respectively. The power unit 12 includes a housing 16 and attached cover 17. FIG. 5 shows more of the construction of the power unit 12, and shows that an electric motor 18 is within the housing 16 and drives an impeller 19. This may be the usual centrifugal impeller which draws air through a central opening 20 and discharges it through an exterior peripheral chamber 21 and then out through openings 22 and 23 into the ambient. The suction created at the central opening 20 leads to an enlarged filter bag mount 25 to which a filter bag 26 may be removably secured. The filter bag may be prevented from collapsing by a screen or foam stiffener 27. A suction hose mount 29 is provided on the end of the housing 16 opposite the motor 18, and this leads down through the cover 17 into either the small tank or the large tank 14, whichever is being used. The power unit also includes a handle 30 which bridges the two main end portions of the housing 16 for easy carrying. Also as shown in FIG. 1, a shoulder carrying strap 31 is provided at the top of the housing 16 so that the vacuum cleaner, especially the small tank vacuum cleaner, may be carried on one's shoulder.

The small tank 13 may be a two-gallon size, for example, and the large tank may be an eight-gallon size, as an example of alternative size tanks for use with the same power unit 12. The small tank 13 is in the form generally of a rectangular solid; however, it has one open side as an access opening. In the preferred embodiment shown, this open side is the top and the access opening 34 is defined by a thickened rim 35 extending around the periphery of all four sides. Fastening means 36 is provided to fasten together the power unit 12 and the small tank 13, and in the preferred embodiment, this fastening means is provided by thrre spring clips made from plastic material, with one clip at an end and two more clips on the long sides of the tank. In this preferred embodiment, the clips are attached to the cover 17 so that this cover may be secured to the small tank 13 at notches 37. The access opening 34 of the small tank 13 is complementary to the underside of the cover 17 and the cover 17 may carry a gasket (not shown), for airtight sealing against this access opening.

FIG. 2 shows the dual vacuum cleaner 11 configured as a large tank vacuum cleaner utilizing the large tank 14. This tank 14 is again in the shape of a rectangular solid, as better shown in FIGS. 2 and 4. This large tank has one open side defining an access opening 40, again with a thickened rim 41. The access opening 40 is complementary to the underside of the cover 17 of the power unit 12, so that the power unit may be received upon the large tank 14. The access opening 40 is preferably identical to the access opening 34 of the small tank so that this poer unit 12 is completely interchangeable with either of the two tanks. The same fastening means 36 is used to fasten the power unit 12 to the large tank 14 when this tank is selected for use. A suction hose 43, extensions 44 and 45, and a floor nozzle 46 are shown in dotted lines in FIG. 2 as examples of suction hose accessories usable with this dual vacuum cleaner 11.

A double wheel mount 49 is used at each end of the large tank 14. Such double wheel mount may be made for plastics, for example, as mounts for two wheels or casters 50 held together by a bridge member 51. Such bridge member is frictionally mounted to the large tank 14 at transverse notches 52, shown in FIG. 4. These bridge members may be held in place by screws not shown, but receivable in bosses 53. At each end of the double wheel mount 49 a central column 55 is open at the bottom to receive the spindle of the respective caster 50. At the top of each double wheel mount, an enlarged aperture 56 is adapted to frictionally receive the various suction hose attachments, such as extensions 44 and 45, and other attachments, such as a crevice tool 57 and a nozzle 58.

A hose connection 60 is provided at the bottom of the large tank 14 for connection to a drain hose where the large tank vacuum cleaner has been used for sucking up spilled liquids.

Operation

The user of the dual vacuum cleaner 11 may select the small tank 13 to be attached to the power unit 12 so that the resulting small tank vacuum cleaner, as shown in FIG. 1, is a compact, lightweight, easily portable unit. It may be carried in one hand by the handle 30, or carried by the shoulder strap 31. Any of the various attachments may be attached at the suction hose mount 29, such as hose 43, entensions 44, 45, floor nozzle 46, crevice tool 57, and nozzle 58. When so configured, the small vacuum cleaner may be readily used for on-the-floor or off-the-floor cleaning, such as draperies and upholstery, or used in more confined spaces such as the floor and upholstery of automobile interiors.

FIG. 2 shows the dual vacuum cleaner 11 configured as a large tank vacuum cleaner which is mounted on wheels for easy movement on a floor. In this configuration, the vacuum cleaner is one which may more readily be used in a basement, patio, workshop, garage, porch, or even any interior room in the home. The suction tool accessories are readily at hand for use whenever needed because they may be mounted in the enlarged apertures 56 to be transportable directly with the large tank vacuum cleaner.

When the householder is through using the vacuum cleaner, it may be quite readily and compactly stored, as shown in FIG. 5. This figure shows the filter bag and foam stiffener 27 as extending down below the cover 17 on the side opposite the motor 18. This filter bag fits readily within the small tank 13, with the cover resting on the thickened rim 35 of the access opening 34 of the small tank. A major portion, in this case about 90 percent, of the small tank is receivable within the large tank 14 through the access opening 40. This major portion of the small tank is everything below the thickened rim 35, so that the thickened rim rests upon the access opening 40 of the large tank 14. In this configuration, the entire vacuum cleaner in the storage condition is only about one inch higher than just the large tank vacuum cleaner 14 itself, as shown in FIG. 2. Therefore, all parts of the vacuum cleaner are readily stored together, and the user may quickly select the desired small or large tank to be attached to the power unit 12 for use. The small tank 13 has length and width dimensions of a major portion thereof which are small enough to fit through the access opening 40 of the large tank and to be received within this large tank. In this preferred embodiment, the length and width dimensions which are so sufficiently small are those dimensions below the thickened rim 35, and the small tank 13 fits in an upright position inside the upright large tank 14.

Figure 4:
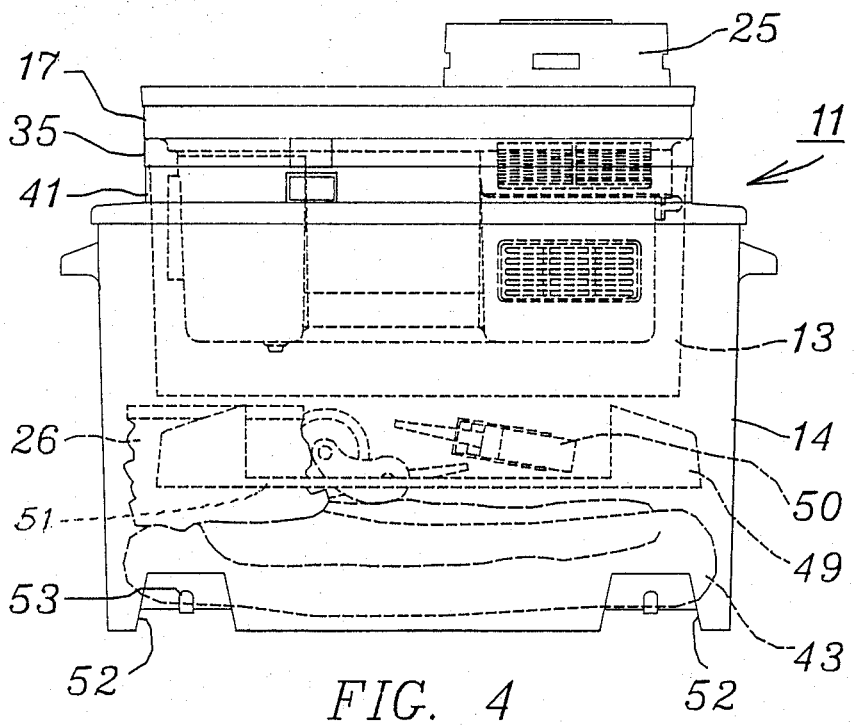
FIG. 4 is a left side elevational view of the dual vacuum cleaner nested for shipping.

FIG. 4 shows the dual vacuum cleaner 11 configured for shipping. The large tank 14 is large enough so that in the bottom there may be packed the suction hose 43, the two wheel mounts 49, the four casters 50, the filter bag 26, and the foam stiffener 27, as well as miscellaneous hardware. On top of this, the small tank 13 may be received inside the large tank with the thickened rim 35 thereof engaging the thickened rim 41 of the access opening 40 of this large tank 14. The housing 16 of the motor unit 12 has length and width dimensions sufficiently small so that it may be inverted and then received within the small tank 13, with the top of the cover 17 resting on the thickened rim 35 of the access opening 34 of the small tank 13. Only the filter bag mount 25 extends up above the cover 17 in this position for compactness in shipping, and for storage, if so desired. When the user unpacks the vacuum cleaner after first purchasing it, the foam stiffener 27 may be placed against the filter bag mount 25 and the filter bag 26 snapped over this stiffener and onto the mount 25. The electrical cord for energizing the electric motor 18 may be uncoiled from its position between the handle and the cover 17, and between the two ends of the housing 16. The double wheel mounts 49 may be secured on the bottom of the large tank 14, and the casters 50 snapped into the central columns 55. The two suction hose extensions 44 and 45 may be mounted inside the cardboard shipping carton on top of the assembly as configured in FIG. 4. FIG. 4 shows that the length and width of the housing 16 of the power unit 12 are sufficiently small that this power unit may be received inverted in this small tank 13 for shipping or storage purposes.

As shown in FIGS. 1 and 2, the power unit 12 is receivable on either the small tank 13 or the large tank 14, and in this preferred embodiment, the power unit fastens to either the large or small tank at the identical position on the power unit. Also, FIG. 4 shows that a major portion of each of the power unit 12 and the small tank 13 have dimensions sufficiently small to permit both major portions to be received within the large tank 14 at the same time for shipping purposes, or even for storage purposes.

The present disclosure includes that contained in the appended claims, as well as that of the foregoing description. Although this invention has been described in its preferred form with a certaim degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A dual vacuum cleaner comprising, in combination:

a power unit, a small tank, and a large tank;

said power unit including a housing with an attached cover;

an electric motor within said housing and an impeller driven by said motor to establish a suction;

said small tank having an access opening;

said access opening of said small tank being complementary to said cover of said power unit to receive said power unit;

said large tank having an access opening identical in size and shape to said access opening of said small tank;

said access opening of said large tank being complementary to said power unit cover to receive said power unit;

means fastening said cover selectively to either said small or large tank access openings for permitting operation of the power unit and selected tank as a vacuum cleaner; and a major portion of said small tank having dimensions sufficiently small to fit inside said large tank at said access opening thereof.

2. A dual vacuum cleaner comprising, in combination:

a power unit, a small tank, and a large tank;

said power unit including a housing with an attached cover;

an electric motor within said housing and an impeller driven by said motor to establish a suction;

said small tank having an access opening;

said access opening of said small tank being complementary to said cover of said power unit to receive said power unit;

said large tank having an access opening identical in size and shape to said access opening of said small tank;

said access opening of said large tank being complementary to said power unit cover to receive said power unit;

means fastening said cover selectively to either said small or large tank access openings for permitting operation of the power unit and selected tank as a vacuum cleaner;

a thickened rim defining said access opening of said small tank; and said small tank being receivable in said access opening of said large tank to the extent that said thickened rim engages said large tank access opening.

3. A dual vacuum cleaner, comprising in combination:

a power unit, a small tank, and a large tank;

said power unit including a housing with an attached cover;

an electric motor within said housing and an impeller driven by said motor to establish a suction;

said small tank having an access opening;

said access opening of said small tank being complementary to said cover of said power unit to receive said power unit;

said large tank having an access opening identical in size and shape to said access opening of said small tank;

said access opening of said large tank being complementary to said power unit cover to receive said power unit;

means fastening said cover selectively to either said small or large tank access openings for permitting operation of the power unit and selected tank as a vacuum cleaner;

one of said power unit and said small tank having a major portion thereof with dimensions sufficiently small to be receivable in said large tank through said access opening thereof;

wheel mounting means adapted to be removably received on the bottom of said large tank;

said wheel mounting means having dimensions suffficiently small to be receivable in said large tank for shipment; and vacuum tool support means on said wheel mounting means.

4. A dual vacuum cleaner comprising, in combination:

a power unit, a small tank, and a large tank;

said power unit including a housing with an attached cover;

an electric motor within said housing and an impeller driven by said motor to establish a suction;

said small tank having an access opening;

said access opening of said small tank being complementary to said cover of said power unit to receive said power unit;

said large tank having an access opening identical in size and shape to said access opening of said small tank;

said access opening of said large tank being complementary to said power unit cover to receive said power unit;

means fastening said cover selectively to either said small or large tank access openings for permitting operation of the power unit and selected tank as a vacuum cleaner;

one of said power unit and said small tank having a major portion thereof with dimensions sufficiently small to be receivable in said large tank through said access opening thereof;

a thickened rim defining said small tank access opening; and said small tank being receivable in said access opening of said large tank to the extent that said thickened rim engages said larger tank access opening for storage and shipping purposes.

5. A dual vacuum cleaner as set forth in claim 4, including a hose attachable to said power unit; and said hose being receivable inside said large tank for shipping purposes.

6. A dual vacuum cleaner as set forth in claim 4, including casters mountable on the exterior of said large tank; and said casters being receivable inside said large tank for shipping purposes.

7. A dual vacuum cleaner as set forth in claim 4, including a filter bag mount on said cover on the side opposite said power unit; and a filter bag securable on said filter bag mount.

8. A dual vacuum cleaner as set forth in claim 7, wherein said filter bag is receivable inside said large tank for shipping purposes.

9. A dual vacuum cleaner comprising, in combination:

a power unit, a small tank, and a large tank;

said power unit including a housing with an attached cover;

an electric motor within said housing and an impeller driven by said motor to establish a suction;

said small tank having an access opening;

said access opening of said small tank being complementary to said cover of said power unit to receive said power unit;

said large tank having an access opening identical in size and shape to said access opening of said small tank;

said access opening of said large tank being complementary to said power unit cover to receive said power unit;

means fastening said cover selectively to either said small or large tank access openings for permitting operation of the power unit and selected tank as a vacuum cleaner;

one of said power unit and said small tank having a major portion thereof with dimensions sufficiently small to be receivable in said large tank through said access opening thereof; and a minor portion of said small tank at said access opening thereof having length and width dimensions larger than the corresponding dimensions of said small tank at a major portion thereof, whereby said major portion of said small tank is receivable in said large tank through said access opening thereof.

10. A dual vacuum cleaner as set forth in claim 9, including said power unit having a major portion thereof with dimensions small enough to be receivable inverted in said small tank through said access opening thereof.

11. A dual vacuum cleaner as set forth in claim 9, including said power unit having a major portion thereof with dimensions small enough to be receivable inverted in said large tank through said access opening thereof.

* * * * *